United States Patent [19]

Walker

[11] 4,030,250

[45] June 21, 1977

[54] DEVICE FOR ACCURATELY SANDING OBJECTS SUCH AS WOODEN OBJECTS AND THE LIKE

[76] Inventor: Leonard B. Walker, 903 S. Washington, Farmington, Mo. 63640

[22] Filed: May 20, 1976

[21] Appl. No.: 688,387

[52] U.S. Cl. ..... 51/128; 51/109 R

[51] Int. Cl.[2] ..... B24B 7/08

[58] Field of Search ..... 51/109 R, 128

[56] References Cited

UNITED STATES PATENTS

| | | | |
|---|---|---|---|
| 1,193,525 | 8/1916 | Dosch | 51/128 |
| 2,000,667 | 5/1935 | Osterholm | 51/128 X |
| 2,315,891 | 4/1943 | Blazek | 51/128 |
| 2,577,206 | 12/1951 | Patterson | 51/109 X |
| 2,645,886 | 7/1953 | Peterson | 51/128 X |
| 2,753,668 | 7/1956 | Strnad | 51/128 |

FOREIGN PATENTS OR APPLICATIONS

| | | | |
|---|---|---|---|
| 331,692 | 7/1930 | United Kingdom | 51/128 |

*Primary Examiner*—Al Lawrence Smith

*Assistant Examiner*—Nicholas P. Godici

*Attorney, Agent, or Firm*—Charles B. Haverstock

[57] ABSTRACT

A table top sanding device adapted for accurately sanding surfaces of objects such as wooden boards and the like including a platform member supported in an operative position, said platform member having a round opening therein, a motor having a motor shaft extending therefrom which is positioned on one side of the platform member with the shaft extending substantially in axial alignment with the opening, said shaft having an end portion located adjacent to the opening, a disc-like sanding member positioned in the opening and attached adjacent to the end portion of the motor shaft for rotation therewith, and structures for relatively rigidly supporting the motor and the disc-like sanding member including parts which can be adjusted to reposition the motor to enable the disc-like sanding member to be adjusted to a desired operative position in the opening. The present device also includes at least one guide member positioned adjacent to the opening for guiding an object to be sanded across the disc-like sanding member.

13 Claims, 5 Drawing Figures

DEVICE FOR ACCURATELY SANDING OBJECTS SUCH AS WOODEN OBJECTS AND THE LIKE

This invention relates to a table top sanding device which is adapted for accurately sanding surfaces of objects such as wooden boards and the like to a substantially smooth and flat condition. A distinction is made between the present sanding device and grinding machines such as those disclosed in U.S. Pat. Nos. 2,000,667, 2,315,891, 2,645,886 and 2,753,668 used for grinding surfaces of metal parts such as engine blocks and the like. Structural and operational requirements for an effective sanding device are different than those for a grinding machine. For example, the grinding machines referred to above require such features as cooling systems, cleaning and washing of grinding members, truing and dressing means for the stone members, and in some cases means for vibrating or oscillating grinding members at the same time that the members are rotating. Features such as these and others are commonly required with most machines used for grinding the surfaces of metal parts. On the other hand, the present device for sanding the surfaces of wooden objects and the like does not require any of these features but instead includes means for relatively rigidly supporting a sanding member for rotation without requiring means for oscillating or vibrating it during rotation. Furthermore, oscillatory or vibrational movements of a rotating sanding member as distinguished from a grinding wheel would make it time-consuming and difficult to prepare substantially smooth and flat surfaces on wooden and like objects, and such movements might actually produce substantial marring and unevenness in the surfaces being sanded. U.S. Pat. No. 2,577,206 discloses a multi-purpose table model device which is convertible from being used as a circular saw, a planer, a shaper, and a sander. To make the change from one use to another, however, requires adjusting fairly complicated tiltable mechanisms. Furthermore, after the change has been made and when its sanding member is positioned in its operative position, it is not possible to make further fine or precision adjustments in the orientation or elevation of the sanding member without completely readjusting the position of the sanding member as well as the other components mounted on the tiltable assembly. This is different from the present device and is in part due to the manner in which the sanding member is mounted and supported during operation, which is also totally different than in the present construction. In addition, the known device is more likely to fall out of adjustment especially when used as a sander because of the way the sanding member is supported, particularly when pressure is applied on the sanding member since pressure on one side of the sanding member will produce a greater torque to move the sanding member out of position than will pressure applied to the other side. These and other disadvantages and shortcomings of the known devices are not present in the present construction.

The present invention teaches the construction and use of a relatively simple, inexpensive and mechanically uncomplicated sanding device which is well suited for production situations where professional woodworking is done and for home workshops and other places where woodworking is done as a hobby or on an occasional basis. The subject device is simple to operate; it requires relatively few mechanical adjustments before being used; and, any adjustments that may be required can be made quickly and easily, even by persons with relatively little mechanical skill. Also, when adjustments are made, they are not likely to change or vary during repeated use. Furthermore, the subject device requires relatively few mechanical parts which are subject to malfunctioning or wearing out or likely to require readjustment; and, the subject device lends itself to being made using known and available materials such as by modifying certain existing structures including work benches, counter tops, and other structures commonly found in home workshops and other places.

Briefly, the subject device includes a platform or table top member with an opening formed therein, a disc-like sanding member which is positioned and relatively rigidly supported for rotation in the opening, motor means positioned on one side of the platform member which include a motor shaft to which the sanding member can be attached, support means for the motor means including means to adjust the position of the motor means and of the sanding member in relation to the opening, and guide means on the platform member which are used to guide objects to be sanded as they are moved over the opening in the platform member and across the sanding member positioned therein.

A main object of the present invention, therefore, is to provide a relatively simple, inexpensive device with which the surfaces of wooden and like objects can be more accurately sanded.

Another object is to teach the construction and use of a simple yet versatile sanding device which is well suited to the home workshop as well as to production situations.

Another object is to provide a sanding device which includes a platform member having an opening therein, and a sanding member which is positioned and relatively rigidly supported for rotation in the opening in an operative position.

Another object is to reduce the time and effort required in preparing substantially flat surfaces of wooden and like objects.

Another object is to provide guide means on the platform member which can be used to guide objects to be sanded over the opening in the platform member and across the sanding member positioned therein, which guide means improve the quality of sanding and reduce the time and effort required to prepare accurately sanded substantially smooth surfaces on wooden objects.

Another object is to provide a mechanically simple sanding device which requires relatively little maintenance and adjustment.

Another object is to provide a sanding device which will require infrequent readjustment after it is once adjusted for operation.

Another object is to minimize scoring and other imperfections in sanded surfaces of wooden and like objects.

Another object is to produce more accurately sanded surfaces on members to be glued or otherwise connected together.

Another object is to reduce the labor required in producing accurately sanded surfaces of wooden and like objects.

Another object is to provide a sanding member for a sanding device which has an abrasive surface thereon that can be easily and economically maintained in a desirable condition for use.

Another object is to teach the construction of a sanding device which allows changing from one type or grade of sandpaper to another with minimum effort and without requiring special tools or removal of parts.

Another object is to teach the construction of a sanding device which allows one sheet of sandpaper to be quickly and simply removed when it becomes undesirable for use, and then replaced with a new sheet.

Yet another object is to provide a sanding device which is simple to operate and adjust and can be used even by persons having relatively little mechanical skill.

These and other objects and advantages of the subject device will become apparent after considering the following detailed specification which covers a preferred embodiment thereof in conjunction with the accompanying drawings wherein like numerals refer to like parts wherever they occur, and wherein.

Figure 1:
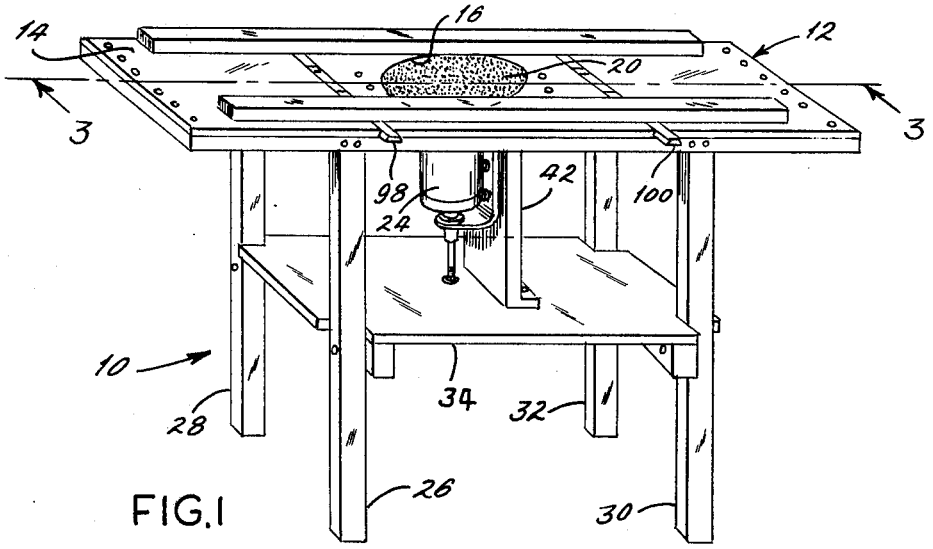
FIG. 1 is a perspective view of a sanding device constructed according to a preferred embodiment of the present invention.

Referring to the drawings more particularly by reference numbers, the number 10 refers to a table top sanding device adapted for accurately sanding surfaces of objects such as wooden boards and the like, and constructed according to a preferred embodiment of the invention.

Figure 3:
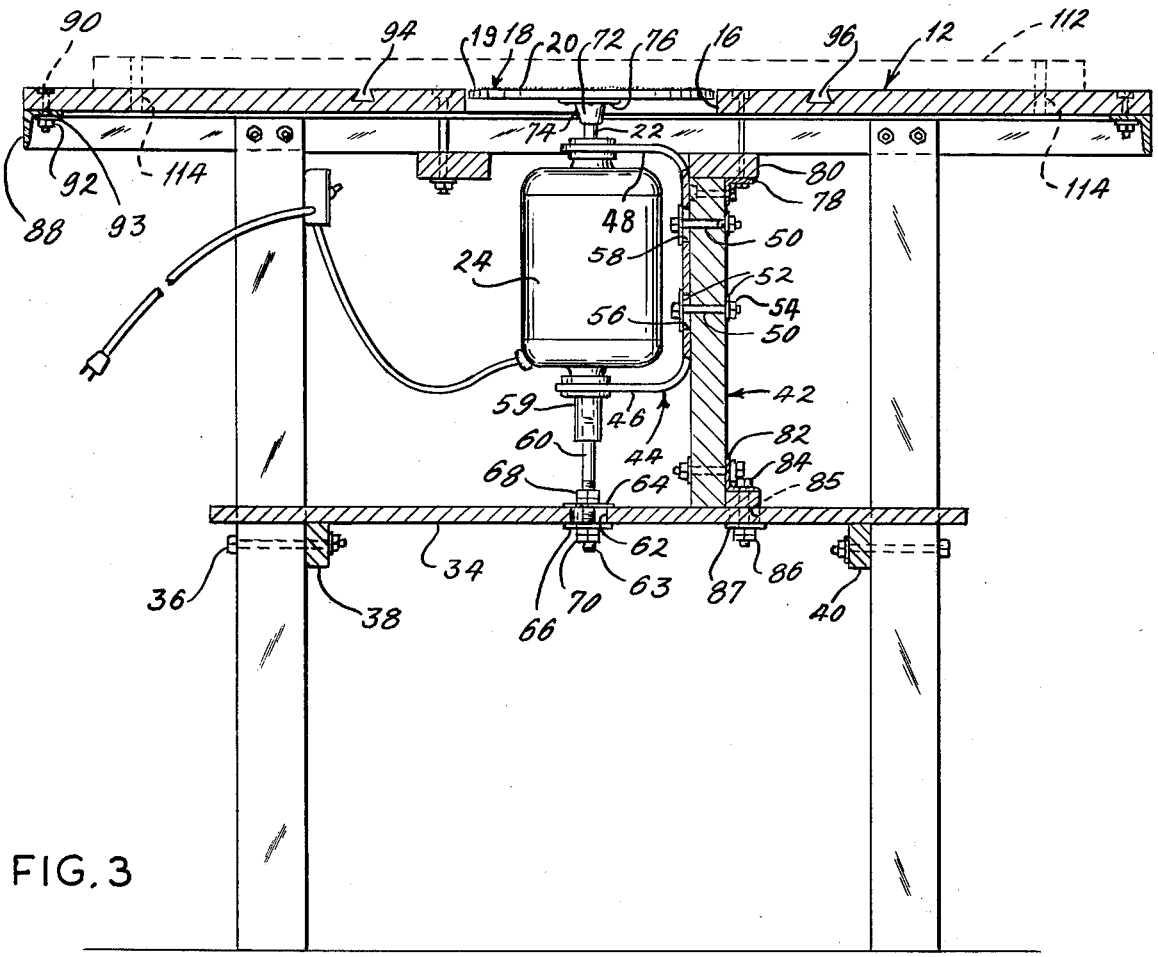
FIG. 3 is a cross-sectional view of the device taken along line 3—3 of FIG. 1.

In FIG. 1, the device 10 is shown including a platform or table top member 12 which has a substantially flat upper surface 14 over which objects to be sanded are moved. The table top 12 has a round opening 16 (FIG. 5) formed at an intermediate location therein, and a device such as disc-like member 18 is mounted for rotation in the opening 16. The member 18 has an upper surface thereon which is substantially flat except possibly for relatively narrow peripheral portion thereof which may be tapered a small amount as indicated at 19. A sandpaper disc 20 is attached to the upper surface of the member 18 preferably by adhesive or similar means, and the member 18 is positioned in the opening 16 so that the sandpaper disc 20 in level with and substantially in the same plane as the upper surface 14 of the table top 12. The member 18 is mounted for rotation on means attached to the upper end of a motor shaft 22 which is oriented to be substantially vertical and in axial alignment with the opening 16 as shown in FIG. 3. The shaft 22 is part of a motor 24 which is mounted beneath the table top 12 as will be described. It is preferred that the member 18 on which the sandpaper disc 20 is attached be a round member, slightly smaller than the diameter of the opening 16, and that the member 18 be accurately positioned as described. The sandpaper disc 20 may include a piece of sandpaper of any suitable coarseness depending on the sanding operation to be performed; and, because of the way the sandpaper disc is preferably attached to the member 18, when one sheet or disc of sandpaper becomes worn, torn or otherwise defective for use, it can be removed such as by simply peeling or tearing it off the member 18, then discarded and replaced by similarly attaching a new sheet.

Figure 5:
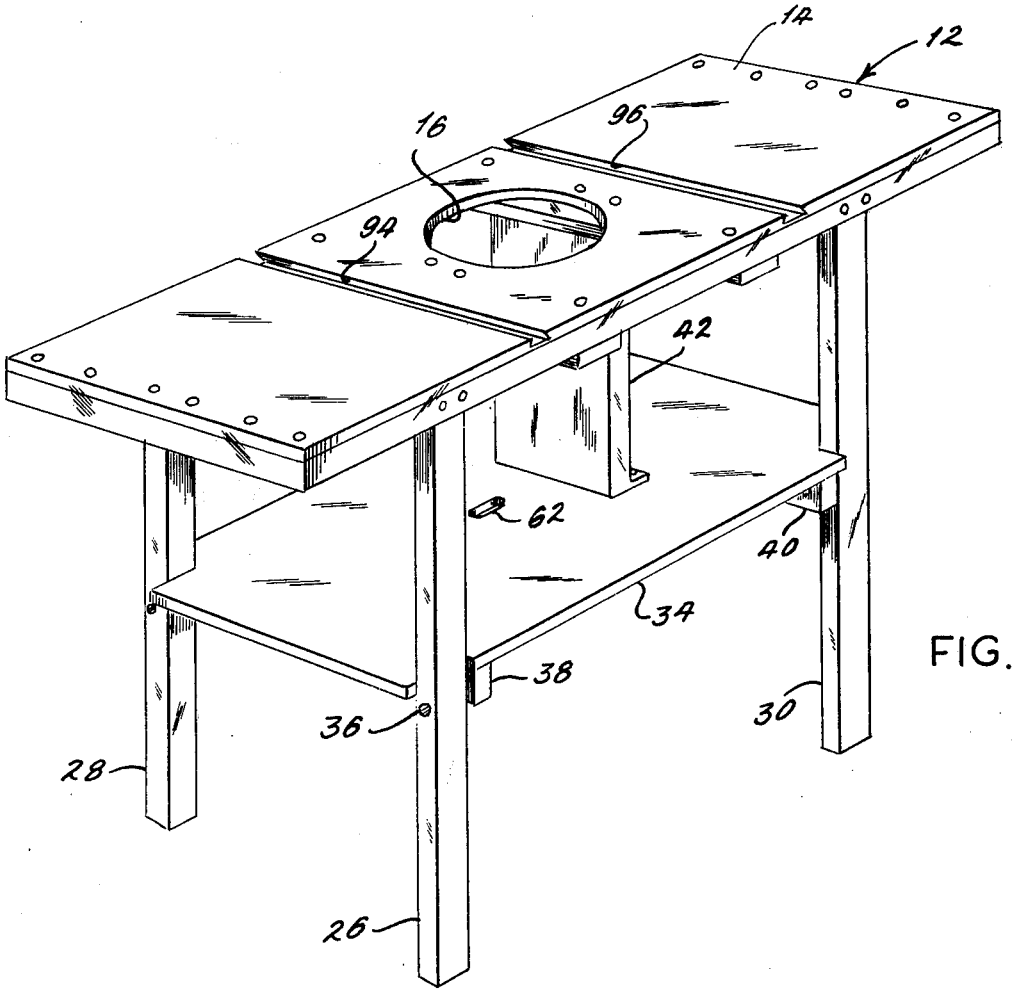

Still referring mainly to FIGS. 1 and 5, the device or table structure 10 is shown including four spaced leg members 26, 28, 30 and 32, the table top 12, and a lower platform or portion 34 which is connected between and supported by the table legs to form a lower shelf and to add stability and strength to the table structure 10. The lower platform 34 can be attached to the legs by various means such as by screws or bolts 36 and brace members such as brace members 38 and 40.

A substantially vertically oriented wall member 42 is mounted extending between the table top 12 and the lower platform or shelf 34 at an intermediate location as shown. The wall member 42 is included to provide means for mounting the motor 24 in the position shown in FIGS. 1 and 3. In FIG. 3, the motor 24 is shown including a substantially U-shaped mounting bracket 44 with spaced leg portions 46 and 48 of the bracket 44 extending to supportably engage the motor 24 adjacent to opposite ends thereof, although motor mounting brackets having other shapes can also be used if desired. The U-shaped bracket 44 is connected to the vertical wall member 42 preferably by threaded connector means such as bolts 50 and washers and lock nuts 52 and 54, and it is further preferred that the bracket 44 be provided with means such as elongated openings 56 and 58 through which the bolts 50 extend so as to allow the motor 24 to be vertically adjustable on the wall member 42.

The lower end of the motor 24 as shown in FIG. 3 includes means 59 which engage the upper end of a vertical shaft 60 which extends downwardly therefrom through an elongated opening 62 formed in the shelf member 34. The shaft 60 provides additional support and backing for the motor 24 and also provides means to vertically adjust the position of the motor in relation to the opening 16 in the table top 12. This is important to the accurate locating of the sandpaper disc 20 and to the best possible support therefor. For these purposes, the shaft 60 preferably has its lower end portion, including the portion that extends through the opening 62 in the shelf 34, externally threaded at 63, and the threaded lower portion of the shaft 60 carries upper and lower washers 64 and 66 and respective lock nuts 68 and 70 which are used to fine or precisely adjust the vertical position of the motor 24 in order to accurately locate the members 18 and 20 in the opening 16.

The motor shaft 22 extends from the upper end of the motor 24 to a location adjacent to the opening 16, and a flanged member 72 is attached to the upper end thereof by means such as set screw 74 or other locking means. The flanged member 72 carries the round disc-like member 18 which can be attached thereto by means such as threaded members 76 or the like. The member 72 can also be made integral with the member 18 which is the member to which the sandpaper disc 20 is adhesively or otherwise attached.

The vertical wall member 42 to which the motor bracket 44 is attached has its upper end connected to the underside of the table top 12 by being bolted or otherwise attached thereto. In the embodiment shown, the upper edge of the vertical wall member 42 is connected with threaded members to one flanged portion of an angle iron member 78, and the opposite portion of the angle iron member 78 receives other threaded members or bolts which attach the angle iron member together with an optional bracing member 80 to the platform or table top member 12.

The lower portion of the vertical wall member 42 is connected to one flange of another angle iron member 82, and the other flange of the angle iron 82 receives other threaded members such as bolts 84 which extend through elongated openings 85 provided therefor in the shelf member 34. The bolts 84 are provided with nuts 86 and lockwashers 87 which can be loosened to adjust the location of the lower end portion of the wall 42 and hence to relocate the orientation of the motor 24 and of the members attached thereto. This adjustment may be made with the adjustment means for the shaft 60 in a loosened condition. Thereafter when the nuts 86 are retightened, fine adjustment of the motor position can be accomplished by adjusting and tightening the shaft 60. Due to the way that the lower portion of the vertical wall member 42 is connected to the platform 34, it can within limits be adjusted relative to the shelf 34 by loosening the threaded members or the nuts and bolts 86 and 84, and in the loosened condition tapping on the lower portion of the vertical wall member in one direction or the other. This is done to relocate the motor 24 by tilting it and the member 18 attached thereto slightly back and forth until the desired operative position for the sandpaper disc 20 is attained. To allow this to be done as stated it may also be necessary to loosen the nuts 68 and 70 on the shaft 60. Once this is accomplished, the nuts 86 are tightened on the bolts 84 to maintain the condition and the nuts 68 and 70 on the threaded portion of the shaft 60 are also retightened to maintain the desired position and support for the motor 24. It is important to provide this additional motor support and backing since otherwise the motor 24 might be able to move and vibrate on the U-shaped bracket 44 or the other motor mounting means. It has been found that by adjusting the height of the motor on the vertical wall member 42 initially and locking it in this position, it is then possible to fine adjust the position of the member 18 in the opening in order to make the sandpaper disc 20 attached thereto engage the objects to be sanded in the most desirable condition during a sanding operation. When a motor adjustment is made by adjusting the position of the lower portion of the vertical wall member 42, it is usually also necessary to adjust the shaft 60 as aforesaid for the reasons stated. These adjustments are usually made together, although it has been found that adjustment of the threaded shaft 60 can be done alone to fine adjust the device and to compensate for looseness and vibration. It has also been found that with the subject device 10 it is possible to make these adjustments so precisely and so accurately that the subject sanding device can be used to produce nearly perfectly sanded boards. A perfectly sanded board in the context used in connection with this invention is one which has its surface so accurately sanded that it can be used to make glue joints, and also can be used as a finished surface for painting, varnishing or for some other purpose. To achieve such a surface, it may be necessary to use several different coarsenesses of sandpaper in the process.

The table top 12 has its upper portion preferably formed of wood, and in the construction shown has a peripheral angle iron frame 88 attached to the underside thereof. The frame 88 is included for added support, and it may also serve as a means for attaching the leg members 26, 28, 30 and 32. The frame 88 can be attached to the table top 12 with threaded means such as screws or bolts 90 and suitable nuts 92 and lock washers 93.

Figure 2:
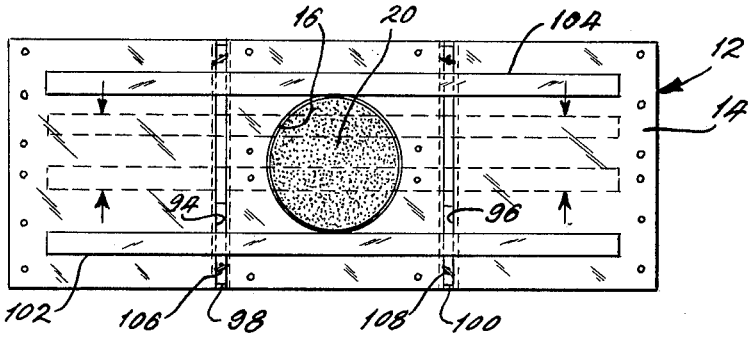
FIG. 2 is a top view of the device shown in FIG. 1.

The upper wooden portion of the table top 12 in the form of the invention disclosed has a pair of spaced parallel grooves 94 and 96 extending thereacross as shown in FIGS. 2, 3 and 5. The grooves 94 and 96 are shown being parallel, and they receive similarly shaped slide members 98 and 100 which are positioned extending therein as shown in FIG. 2. A guide member such as guide member 102 is attached to the slide members 98 and 100 by threaded or other fasteners or the like and during operation is usually positioned extending along the length of the table top 12 adjacent to one side of the opening 16. However, it will be appreciated that because of the track means provided for mounting the guide member 102 on the table top 12, it can be moved to other desired positions relative to the opening 16 depending upon the width of a workpiece to be sanded. Another guide member 104 is shown in FIG. 2 mounted on the table top 12 at a position spaced from the guide member 102. The guide member 104 can be positioned adjacent to the opposite side of the opening 16 from the guide member 102 as shown or at any other convenient location, depending on the width of the workpieces to be sanded and the desired clearance. One or both guide members can also be movable during a sanding operation. In this respect, it is usually preferred that the spacing between the guide members 102 and 104 be adjusted so that the guide members are relatively close to opposite sides of an object to be sanded, although not necessarily actually engaging the opposite sides thereof. Proper spacing of the guide members has been found to substantially prevent undesirable marring and scoring of the surfaces of workpieces being sanded; it improves control of the workpiece; and, it improves the accuracy with which sanding operations can be done. At the same time, providing some clearance between the guide members and the workpieces prevents the guide members from binding on a workpiece and makes it relatively easy to move the workpiece between them. One or both of the guide members 102 and 104 can also be provided with locking means such as thumb bolts 106 and 108 which can be advanced through the slide members to which the respective guide members are attached and into engagement with the table top 12 to secure the guide members in place after they have been adjusted for use. The guide members 102 and 104 are important to the present invention especially when the device is to be used to sand relatively long boards because they allow the boards to be more accurately guided across the sandpaper disc 20 attached to the member 18. Furthermore, the guide members stabilize the workpiece as it is being sanded and prevent vibrational or other undesirable movements of the workpiece which might produce inaccuracies and other imperfections in the surfaces being sanded. The guide members 102 and 104 may also be attached in position so as to be spaced slightly above the surface 14 of the table top 12 so that they can extend over the sanding disc 20 without being in contact therewith. This can be accomplished by making the slide members 98 and 100 somewhat deeper than the grooves 94 and 96 in which they are positioned. Washers (not shown) can also be provided between the guides 102 and 104 and the respective slides 98 and 100 for this purpose.

Figure 4:
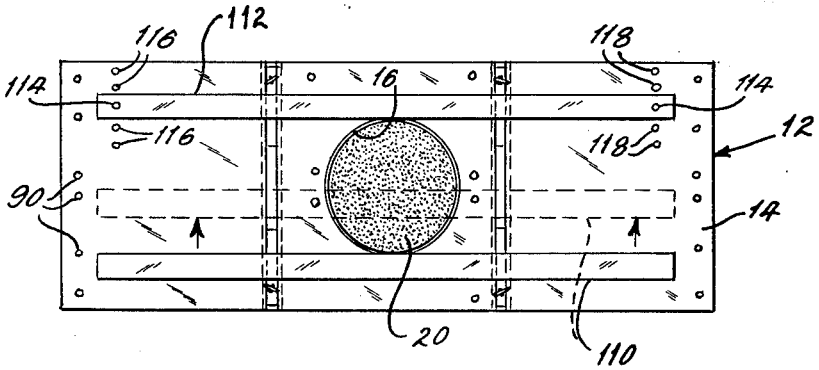
FIG. 4 is a view similar to FIG. 2 but showing a modified form of guide means for use with the device; and, FIG. 5 is a perspective view showing the table portion per se of the device of FIG. 1.

In FIG. 4, a modified form of guide means suitable for use with the subject device 10 is shown and includes an adjustable guide member of rail 110 which can be mounted and positioned similarly to either of the guide rails 102 or 104 described above. A second guide rail 112 is attached to the table top 12 at a fixed location usually adjacent to the opposite side of the opening 16 from the rail 110. For attaching the guide rail 112 to the table top 12, threaded fasteners can be used, or the guide rail 112 may be provided with attached depending pegs such as pegs 114 (shown also in dotted outline in FIG. 3) or similar means for cooperating with spaced sets of openings such as openings 116 and 118 or like means provided therefor in the table top. This enables the guide rail 112 to be relocated to various fixed positions relative to the opening 16 as desired depending on the number of sets of such openings or holes provided. Here also location of the guide members 110 and 112 is dependent on the width of the objects to be sanded. In most other respects, the guide rails 110 and 112 are similar to the guide members 102 and 104 above, and they serve the same general purposes.

So far as known, it has not heretofore been proposed to provide a sanding device which can be as accurately and precisely adjusted as the present construction, and which provides means by which a workpiece can be as accurately and precisely sanded by moving it across a rotating sanding disc and in as stable and as easily and accurately controlled manner. These features distinguish the present device from grinding and other like machines, which while they may have some general similarity to the present device, are not suitable for use as sanders for various reasons including those mentioned above and the fact that grinders use grinding stones which need to be lubricated or cooled, and which require different kinds of adjustment means that are more complicated than the present adjustment means and require more frequent readjustment especially as the grinding member or stone wears. The same is not true of the present construction. The present invention, therefore, teaches a relatively simple yet highly useful and accurate means for sanding surfaces of objects such as wooden boards and the like. The subject device is flexible so that it can be used to sand many different sizes and shapes of objects; it can be relatively quickly and accurately adjusted when desired; and once set in an adjustment for operation, it does not require frequent readjustments or cooling for effective use. These are important differences between the present device and all known prior art devices.

Thus there has been shown and described a novel sanding device adapted for accurately sanding the surfaces of objects such as wooden boards and the like, which device fulfills all of the objects and advantages sought therefor. It will be apparent, however, that many changes, modifications, variations, and other uses and applications of the subject device can be made and are contemplated. For example, to facilitate manufacturing and for other reasons, the subject device and its components can be constructed of various materials including metal and plastic materials in addition to the wooden materials mentioned above. Such materials can be used for the major components of the subject device such as for the table top portion as well as for the other portions thereof. These and all other such changes, modifications, variations, and other uses and applications which do not depart from the spirit and scope of the invention are deemed to be covered by the invention which is limited only by the claims which follow.

What is claimed:

1. A device for sanding surfaces of wooden boards and like objects comprising a platform member having a substantially flat surface over which objects to be sanded are to be moved, said platform member having a round opening formed at an intermediate location therein, means for supporting said platform member in an operative position, motor means positioned on one side of said platform member, said motor means including a motor shaft which extends substantially in axial alignment with said opening, said shaft having an end portion located adjacent to the opening, means for supporting the motor means including means to reposition the end portion of said shaft relative to the opening in the platform member, said motor support means including a first support member attached to the platform member and oriented to extend in substantially perpendicular relationship thereto, said motor means being attached to said first support member, and second motor support means including a second support member spaced from the platform member, means connecting the first support member to the second support member at substantially a right angle, and means associated with said second motor support means to adjust the position of the motor means and of the motor shaft relative to the opening in the platform member, said last named means including an adjustable motor support member having spaced opposite end portions, one of the opposite end portions engaging the motor means opposite from the platform member, and means on said second support member for supporting said adjustable motor support member adjacent to the other opposite end portion thereof, means to adjust the orientation of the first motor support member relative to the platform member including means to adjust the angular relation between the first and second motor support members, a disc-like member attached to the end portion of the motor shaft, said disc-like member having means forming an abrasive surface thereon, said disc-like member being positioned to be rotated in the opening in the platform member with the abrasive surface in substantially coplanar relationship with said flat surface of the platform member, and guide means on the platform member including a pair of spaced parallel guide members positioned adjacent opposite sides of the opening for guiding objects to be sanded as they are moved over the opening in the platform member and across the abrasive surface on the disc-like member.

2. The sanding device defined in claim 1 wherein said means on the second motor support member for supporting said adjustable motor support member include threaded adjustment means.

3. The sanding device defined in claim 1 including means to relocate the motor means on the first motor support member.

4. The sanding device defined in claim 1 wherein the means forming an abrasive surface on the disc-like member include a sandpaper disc attached thereto.

5. The sanding device defined in claim 1 wherein one of the guide members of said pair of guide members is fixed on the platform member.

6. The sanding device defined in claim 1 including means to relocate at least one of the guide members of said pair of guide members relative to the opening in the platform member.

7. A device for sanding surfaces of wooden and like objects comprising an upper platform member having a substantially flat work-support surface with a round opening at an intermediate location therein, means for supporting said platform member in an operative position, motor means positioned below said platform member, said motor means including a motor shaft oriented to extend in substantially axial alignment with the platform opening, said shaft having an upper end portion located adjacent to the opening, means for supporting the motor means including means to adjust the alignment and vertical position of said shaft relative to the opening, said motor support means including a first support member having spaced opposite ends and oriented to extend in substantially perpendicular relationship to the platform member, one of the opposite ends of the first support member being located adjacent to the platform member and including means for attaching it thereto, second motor support means including a second support member and means for attaching the other of the opposite ends of the first support member thereto, said second support member being positioned spaced below the motor means and extending in substantially parallel relationship to the platform member, means for maintaining the second support member and the platform member in fixed spaced relationship, means to adjust the vertical position of the motor means and the end portion of the motor shaft relative to said opening, means to adjust the orientation of the first support member relative to the platform member to adjust the alignment of said motor shaft relative to the opening in said platform member, a disc-like member attached to the end portion of the motor shaft, means forming an abrasive surface on said disc-like member, said disc-like member being positioned to be rotated in the opening in the platform member with the abrasive surface in substantially coplanar relationship with said flat surface on the platform member, guide means on the platform member including a pair of spaced parallel guide members positioned adjacent opposite sides of the opening, and means to adjust the position of at least one of the guide members of said pair of guide members relative to the opening and relative to the other guide member to control the spacing therebetween.

8. A device for sanding surfaces of wooden boards and like objects comprising a table top member having a substantially flat work-support surface with an opening formed at an intermediate location therein, leg members attached at spaced locations to the table top member to support it in an elevated position, a shelf member connected between and supported by the leg members at a location spaced below the table top member and in substantially parallel relationship thereto, motor means positioned in the space between the table top and shelf members including a motor shaft having an end portion extending to a location adjacent to said opening, a flanged member attached to the end portion of the shaft and having a surface thereon in the opening, means for supporting the motor means including means to adjust the alignment and vertical position of said shaft relative to the opening, said motor support means including a first support member positioned extending between the table top member and the shelf member, said first support member having a lower end portion positioned adjacent to the shelf member, and means for adjustably attaching said lower end portion to the shelf member to change the angular orientation of the motor relative to the table top member, and second motor support means including a support rod positioned in the space between the motor means and the shelf member, and means for adjusting the position of the support rod relative to the shelf member to adjust the vertical position of said motor shaft relative to the opening in the table top member, an abrasive member attached to the surface of the flanged member and positioned to be substantially in the same plane as the work-support surface of the table top member, and guide means on the table top member including at least one guide member positioned adjacent to the opening therein.

9. The sanding device defined in claim 8 wherein the abrasive member includes a sandpaper disc adhesively attached to the surface of the flanged member.

10. The sanding device defined in claim 8 wherein the motor means include a mounting bracket and means for attaching the mounting bracket to the first support member.

11. The sanding device defined in claim 10 including means associated with the mounting bracket for adjusting the position of the motor means on the first support member.

12. The sanding device defined in claim 8 wherein the shelf member has an opening formed therein, and the support rod has a threaded lower end portion which extends through the shelf opening, and adjustment means carried on the threaded lower end portion of the support rod engageable with the shelf member to adjust the position thereof relative to the shelf member.

13. The sanding device defined in claim 8 wherein said guide means on the table top member include a pair of guide members positioned adjacent to opposite sides of the opening, and including track means for mounting at least one of the guide members of said pair of guide members on the table top member, said track means allowing the spacing between the pair of guide members to be adjusted to correspond approximately with the widths of objects to be sanded.

* * * * *